United States Patent [19]

Hooper

[11] Patent Number: 4,781,153

[45] Date of Patent: Nov. 1, 1988

[54] INTERNAL COMBUSTION ENGINE

[76] Inventor: Bernard Hooper, High Woodland Littlegain, Hilton, Nr Bridgenorth, Shropshire, United Kingdom

[21] Appl. No.: 80,538

[22] PCT Filed: Oct. 13, 1986

[86] PCT No.: PCT/GB86/00620

§ 371 Date: Jun. 9, 1987

§ 102(e) Date: Jun. 9, 1987

[87] PCT Pub. No.: WO87/02416

PCT Pub. Date: Apr. 23, 1987

[30] Foreign Application Priority Data

Oct. 19, 1985 [GB] United Kingdom ..... 8525854

[51] Int. Cl.[4] ..... F02B 75/20

[52] U.S. Cl. ..... 123/59 BS; 123/65 S

[58] Field of Search ..... 123/59 BS, 65 S, 73 F, 123/71 R, 318

[56] References Cited

U.S. PATENT DOCUMENTS

| | | | |
|---|---|---|---|
| 1,001,485 | 8/1911 | Wells | 123/73 F |
| 1,465,885 | 8/1923 | Wege | 123/59 BS |
| 3,301,237 | 1/1967 | Wolf | 123/59 BS |
| 3,550,569 | 12/1970 | Hooper | 123/71 R |
| 3,641,987 | 2/1972 | Hooper | 123/71 R |
| 3,731,662 | 5/1973 | Fandrich | 123/71 R |
| 4,630,591 | 12/1986 | Hooper | 123/73 F |

FOREIGN PATENT DOCUMENTS

| | | | |
|---|---|---|---|
| 421220 | 2/1911 | France | 123/59 BS |
| 2319768 | 2/1977 | France . | |

*Primary Examiner*—Charles J. Myhre
*Assistant Examiner*—David A. Okonsky
*Attorney, Agent, or Firm*—Parmelee, Miller, Welsh & Kratz

[57] ABSTRACT

An internal combustion engine has a pair of stepped cylinders (14,15) in which stepped pistons (P1,P2) are received, each cylinder (14,15) and piston (P1,P2) having a pumping part of larger diameter and a working part of smaller diameter transfer paths from each of the pumping parts of each cylinder to the working part of the other comprising first passage parts (27,27') extending from the pumping parts (**15*a*,14*a*) to second passage parts (28,28') and third passage parts comprising at least two branches (29,29') connecting the second passage parts (28,28') and the working parts (16*a*,16*b*) of the cylinder, the first (27,27') and third (29,29') passage parts each crossing an interface (1) between the crankcase 12 and cylinder block (11) via aligned parts, and the second passage parts (28,28') being wholly contained in the crankcase (12**).

10 Claims, 2 Drawing Sheets

INTERNAL COMBUSTION ENGINE

DESCRIPTION OF INVENTION

This invention relates to an internal combustion engine and more particularly, to an internal combustion engine of the kind hereinafter referred to as "of the kind speciifed" having at least one pair of cylinders each containing a stepped piston, each cylinder and piston having a pumping part of larger diameter and a working part of smaller diameter, the working part of each cylinder being charged by precompressed charge (as herein defined) delivered from the pumping part of the other cylinder.

By a "charge" we mean a mixture of air and fuel, or air alone, in which latter case at least fuel would need to be injected or otherwise introduced into the working part of each cylinder by further means.

In an engine of the kind specified, a transfer path, which may have one or more branches, extends from the pumping part of one cylinder to the working part of the other cylinder. In known engines of the kind specified, there are two ways of providing such a transfer path.

First, the transfer path is provided by a passage in the crank case casting which passage comprises a first passage part which extends generally parallel to the axis of movement of the piston from the pumping part of one cylinder, to a second passage part transverse to said axis which second part opens into the working part of the other cylinder.

Such a transfer path has disadvantages in that (a), providing a casting with such a passage in the crank case, requires a complicated technique involving specialised labour and thus increasing costs, and (b), the charge has to change direction suddenly in order to pass from the first to the second passage part. The second passage part is usually short in length due to the restricted space available in the casting, so that the charge has to change direction immediately before passing into the working part of the cylinder. This can be detrimental to efficient scavenging in an engine of the kind specified.

Secondly, a transfer path is provided using a manifold which is secured to the cylinder block. A first passage part extends from a first position on the interface of the crank case and the manifold, to the pumping part of each cylinder and a second passage part which extends from said first position on the interface, through the manifold, back to the second position on the interface, and a third passage part extends from said second interface position to the working part of the cylinder. Such an arrangement is simpler in construction compared with the first described arrangement as the passage parts each open to the interface. However, at least the manifold, which is usually provided as a casting, requires sand casting and it will be appreciated that the precompressed charge still has to flow along a tortuous transfer path and so this second arrangement suffers from many of the disadvantages of the first described arrangement. Further, it is not readily possible where a manifold is provided, to arrange two pairs of cylinders in a V formation because of restriction in available space.

According, it is an object of the present invention to provide a new or improved internal combustion engine which overcomes or reduces these disadvantages of known arrangements.

According to the invention I provide an internal combustion engine of the kind specified, having a crank case (as herein defined) and at least one cylinder block secured together at an interface, the crank case and the at least one cylinder block together defining the two cylinders in which the stepped pistons are slidable, the pistons each being connected to a crank shaft mounted in the crank case, a transfer path along which said precompressed charge may flow from the pumping part of each cylinder to the working part of the other cylinder, in which the charge is ignited, each transfer path comprising first, second and third passage parts, the first passage part communicating with the pumping part of one cylinder and the second passage part, and the third passage part comprising at least two branches each communicating with the second passage part and the working part of the other cylinder, characterised in that the first and third passage parts each cross the interface between the crank case and the at least one cylinder block via aligned ports in the crankcase and the at least one cylinder block and the second passage part is wholly contained within the crankcase.

Thus such an arrangement obviates the necessity to use any separate manifold and this considerably simplifies construction of the engine. More particularly, two pairs of cylinder blocks may be provided in a V formation, because as no separate manifold is provided, there is no restriction in space.

It will be appreciated that throughout this specification, the term "crank case" includes a main crankcase casting and a, usually lower, auxiliary crank case, sump or cover plate which is provided to close the, usually lower, open end of the main crank case casting and comprises a closure means.

In one embodiment, the first and third passage parts extend from the respective ports of the interface, through the main crank case casting, to the open end of the crankcase casting, and the second passage part is defined at least partly by the closure means.

The open end of the crank case which is closed in use, by the closure means, preferably defines a first plane inclined relative to a second plane which is defined by the interface of the crank case and the at least one cylinder block.

Thus the main crank case casting at least can be easily produced by diecasting, thus reducing costs in bulk production.

The branches of the third passage parts preferably each extend generally perpendicularly to the first plane, to facilitate die-casting, although some draft may be required to facilitate die removal after casting.

The branches of the third passage parts which extend from the ports of the at least one cylinder block may enter the working part of their associated cylinders in directions which are generally tangential to the associated cylinder so that the charge is not required to make any sudden tortuous change of direction immediately before entering the working part of the cylinder. Thus efficient scavaging can be achieved.

Preferably the ports of the branches of the third passage part of one transfer path are arranged either side of the port of the first passage part of the other transfer path at the interface. The port of the first passage part of the transfer path from the pumping part of one cylinder may be arranged adjacent the periphery of said one cylinder, with the ports of the branches of the third passage part of the other transfer path at either side.

The three ports adjacent the periphery of each cylinder may be arranged along a line generally parallel to the plane containing the central axes of both cylinders of the pair, but preferably the line is inclined relative to the plane.

Preferably however, the port of the first passage part, and adjacent ports of the third passage part of the other transfer path, are arranged along an arc generally concentric with the respective cylinder.

The ports of each group of three parts are preferably centred on a radius of the respective cylinder inclined relative to a plane containing the central axes of the cylinders, at an angle other than 90°.

Preferably the second passage parts of each of the transfer paths are generally straight along a major portion of their length, so that a precompressed charge does not have to follow a tortuous path as the charge passes along the respective second passage part. The major protion of each second passage part may extend along a respective axis which may be generally parallel to, or transverse relative to the second plan defined by the interface between the crank case the at least one cylinder block.

A pair of cylinder blocks may be provided, each defining part of one cylinder of the pair. This provides a major advantage over known engines of the kind specified in which, usually, a single cylinder block is provided, which defines parts of both cylinders of the pair. Production of cylinder blocks is considerably facilitated because a single cylinder block can be bored whilst being turned to ensure perfect roundness of the cylinder part, whereas a double cylinder block has to be bored when stationary, which can lead to inaccuracies.

The interface between the at least one cylinder block and the crank case may be provided at the step between the greater diameter pumping parts and the smaller diameter working parts of the cylinders.

Thus the port of the first passage part provided in the at least one cylinder block of each transfer path, may overlap the periphery of the larger diameter cylinder part of the crankcase so that the precompressed charge does not change direction in order to pass from the pumping part of the cylinder into the first passage part. The port may also overlap with the port of the first passage part of the crankcase so that the port in the cylinder block constrains the charge to change direction before entering the first passage part in the crankcase.

In one embodiment, the engine is provided with two pairs of cylinders each pair of cylinders being arranged in a V formation, with at least one cylinder block of each pair adjoining the crank case at spaced interfaces inclined relative to one another. Preferably the interfaces are arranged relative to one another generally perpendicularly so that the V angle is approximately 90°.

The invention will now be described with the aid of the accompanying drawings in which.

Figure 1:
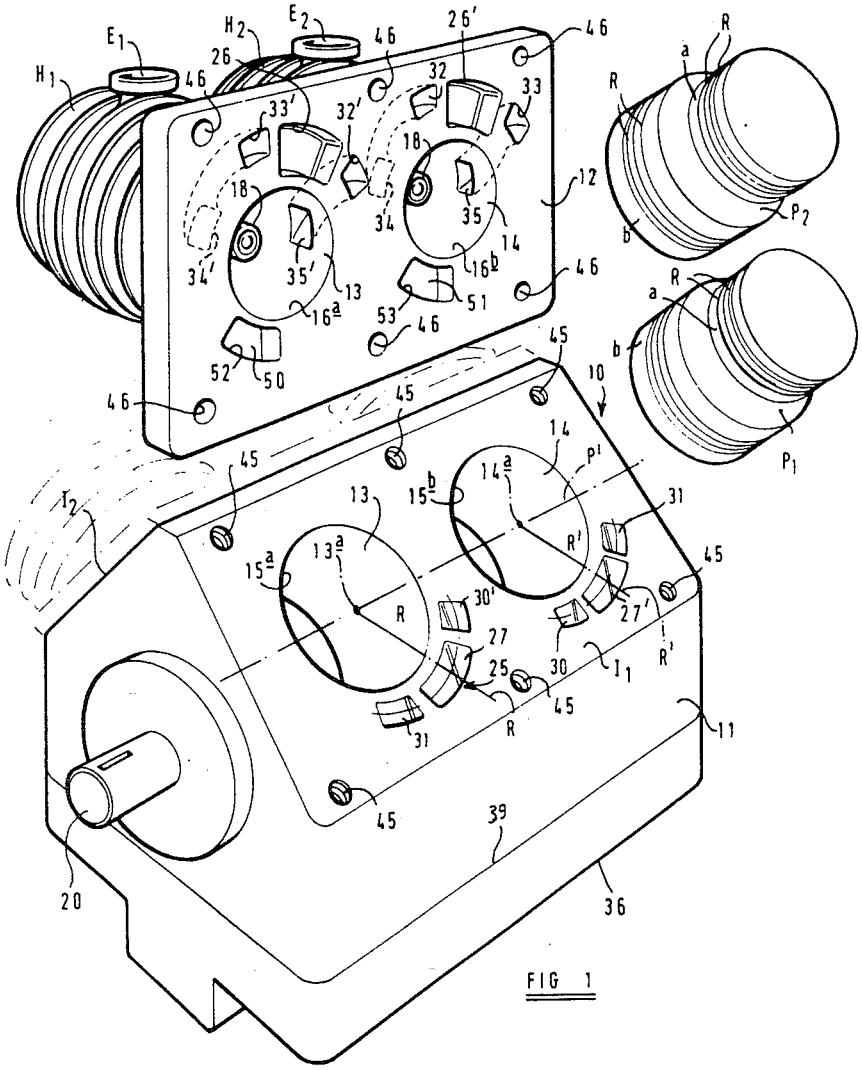
FIG. 1 is an exploded and diagrammatic view of an internal combustion engine in accordance with the invention, with the pistons removed for clarity.

Referring first to FIG. 1, an internal combustion engine 10 comprises a crank case 11 and a cylinder block 12, the crank case 11 and cylinder block 12 which, when assembled together, define a first cylinder 13 and a second cylinder 14.

The engine is of the stepped piston kind in which the cylinders 13, 14, each have a larger diameter pumping part 15*a*, 15*b* respectively, provided solely in the crank case 11 and a smaller diameter working part 16*a* 16*b* respectively solely in the cylinder block 12, the step between the larger and smaller diameter parts, being provided at an interface $1_1$, between the crank case 11 and cylinder block 12. The cylinders 13,14, each receive a piston P1,P2 respectively, which are each connected by conventional rods and bearings to a common crank shaft 20 which is received in the crank case 11 in suitable bearings, and each piston P1,P2, reciprocates in its respective cylinder 13,14, along an axis 13*a*,14*a*.

In use, a charge, that is a mixture of air and fuel, is precompressed in the pumping part 15*a*, 15*b* of each cylinder 13, 14, and fed to the working part 16*b*, 16*a* respectively of the other cylinder where the charge is ignited. To achieve this, the pistons P1,P2, which are received in the cylinders 13, 14, are also stepped having a larger diameter pumping part a and a smaller diameter part b each sealed relative to the cylinder by conventional piston rings R.

Ignition is achieved in the present example, by spark plugs 18 received in cylinder heads H1 and H2 respectively of the cylinder block 12 which heads H1,H2 are secured to the cylinder block 12 in conventional manner. Alternatively, the engine could be of the diesel type in which the precompressed charge, which is further compressed in the working parts 16*a*, 16*b* of the cylinders 13, 14, spontaneously ignites due to the rise in temperature of the charge as further compression takes place. Another alternative is that the charge which is precompressed may comprise air only, or a weak/air fuel mixture, with fuel being injected directly into the working part of each cylinder by suitable injector means.

The engine 10 shown is of the cross over type in which the charge is precompressed in the pumping part 15*a* of the cylinder 13, and delivered by a first transfer path to the working part 16*b* of the second cylinder 14, and a charge is precompressed in the pumping part 15*b* of the second cylinder 14 and delivered via a second transfer path to the working part 16*a* of the first cylinder 13. Thus by arranging for the pistons to be 180° out of phase with one another, there is no necessity to store precompressed charge whilst the directions of reciprocation of the pistons reverse to provide working chambers between the working parts a of the pistons P1,P2, and the working parts 16*a*,16*b* of the cylinders 13,14.

Figure 2:
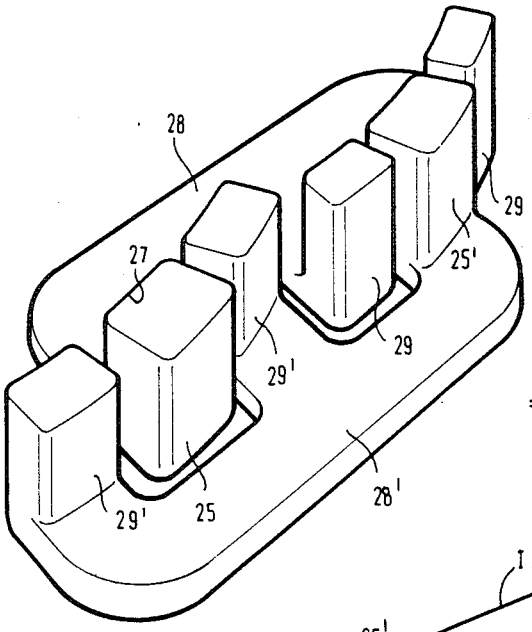
FIG. 2 is an illustrative perspective view showing the arrangement of passage parts of first and second transfer paths in the crank case of the engine of FIG. 1.

Referring now also to FIG. 2, a transfer path from pumping part 15*a* to working part 16*b* comprises a first passage part 25 which crosses an interface $1_1$, between the crank case 11 and cylinder block 12, the first passage part 25 having a port 26 in the cylinder block 12, which, when the cylinder block 12 and crankcase 11 are secured together, overlaps the periphery of the larger diameter stepped part 15*a* of cylinder 13, and overlaps an aligned port 27 in the crankcase 11. The first passage part 25 extends from port 27 to a second passage part 28 which is wholly contained by the crank case 11.

A third passage part comprises two branches 29 which each communicate with the second passage part 28, and extend to ports 30, 31, well spaced from port 27, but which open at the interface $1_1$. The ports 30, 31, are aligned with respective ports 32,33, in the cylinder block 12 and thus the branches 29 of the third passage part also cross interface $1_1$. The ports 32,33, communicate with the working part **16*b* of cylinder 14 via ports 34,35**, respectively.

It can be seen that the branches of the third passage part 29 in the cylinder block 12, at least immediately adjacent the ports 34,35, extend tangentially to the cylinders 13,14, to ensure scavenging.

The transfer path from pumping part **15*b* to working part 16*a* similarly comprises first and third passage parts which cross the interface $1_1$and a second passage part which is contained wholly within the crankcase 11**, and connects the first and third passage parts. Similar parts to the other transfer path already described in detail, are labelled by similar reference numbers but with a prime sign added.

It can be seen that the ports 30,31, at the interface $1_1$ are either side of the first passage part port 27' of the other transfer path, and that the ports 30',31', at the interface $1_1$ are either side of the first passage part port 27 of the first described transfer path. Further, the three ports of each group i.e. ports 30,27',31, and 31',27,30', are each arranged along a respective arc which is generally concentric with the associated cylinder 14, 13. Each grop of three ports 30,27',31;31',27,30' are preferably centred on a radius R inclined relative to a plane P which contains the central axes **13*a*,14*a*** of the cylinders, at an angle other than 90°.

It has been found that this arrangement permits of close nesting of the cylinders 13 and 14 without the various passage parts taking up undue space in the casting of the crank case 11.

The passage parts 25,25',28,28',29,29' in the crank case 11, are all easily provided in the crank case 12 by a die casting technique. This is because, as can be seen from FIG. 3, the passage parts 25,25' and 29,29', are all generally perpendicular to a plane defined by an open end 39 of the main crankcase casting, and extend from the interface $1_1$ through to the open end 39. An auxiliary crankcase or sump 36 in use, closes the open end 39 and has cast therein, two grooves 37, 28, configured so that groove 37 together with the main crankcase casting, defines the second passage part 38 which communicates with the first and third passage parts 25 and 29, and groove 38 is so configured so as to provide with the main crankcase casting, the second passage part 28' of the other transfer path, which communicates with the first and third passage parts 25',29'.

Because the passage parts 25,25',29,29' do not take up undue space in the crankcase 11 there is ample room at the interface $1_1$ for the provision of tapped holes as shown at 45 (in FIG. 1) to receive bolts which pass through aligned openings 46 in the cylinder block 12 to enable the cylinder block 12 and crank case 11 to be secured together.

The charge is delivered to the pumping parts **15*a* and 15*b* of the cylinders 13 and 14, after passing along further passages 50, 51, respectively in the cylinder block 12 and which opens at the interface 1, at ports 52, 53, which ports 52,53, communicate with the pumping parts 15*a*,15*b* of the crank case 11 by overlapping the respective step periphery. Carburettors or a manifold extending to a carburettor can be secured to the cylinder block 12 in order to provide the charge to the passages 50,51** through suitable valves, for example, reed valves.

Exhaust ports from the cylinder block 12 are shown at E1 and E2.

As shown, the crank case 11 provides for only two cylinders 13 and 14 arranged side by side although of course, more than one pair of cylinders could be provided side by side.

Figure 3:
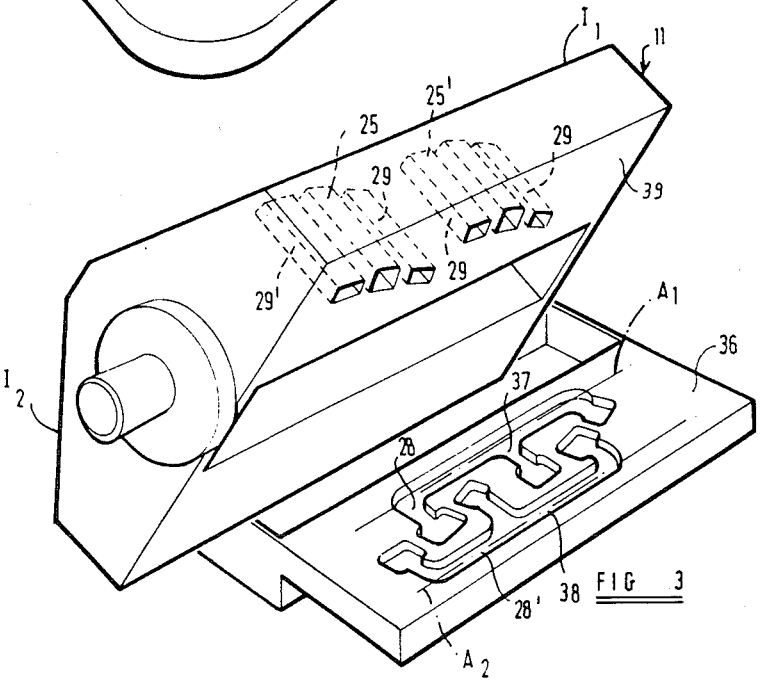
FIG. 3 is an exploded perspective view of part of the underside of the main crank case casting and auxiliary crank case or sump, of the engine of FIG. 1.

It can be seen from FIG. 3, that the major portion of the second passage parts 28,28' of both the transfer paths, extend along axes A1 and A2 respectively. In the present example, the axes A1 and A2 are generally parallel, and are also each generally parallel with a plane defined by the interface $1_1$.

In an alternative embodiment, the axes A1, A2, may be inclined relative to the plane defined by the interface $1_1$. The axes A1 and A2 may be inclined in a common direction or in opposite directions as required. This inclination may be arranged by suitably casting the open end 39 of the main crankcase casting and grooves 37,38 provided in the auxiliary crank case or sump 36.

Because the ports 26 and 26' of each of the transfer paths overlap the periphery of the larger diameter stepped parts **15*a*,15*b* of the cylinders 13,14, it will be appreciated that the precompressed charge does not need to change direction before entering the first passage part 25,25', although immediately upon entering the first passage part i.e. the ports 26, 26' in the cylinder block, the charge needs to change direction so as to pass through ports 27,27' into the first passage parts 25,25' provided within the crank case 11**.

The charge needs again to change direction so as to pass into the second passage parts 28,28', and again to pass into the branches of the third passage parts 29,29' but then the charge can continue without any sudden change in direction to pass through ports 32,33,32',33' into the respective working parts **16*b*,16*a* of the cylinders 14,13**.

If desired, a second pair of cylinders may be provided at another interface $1_2$ on the opposite side of the engine to interface $1_1$ as shown in dotted lines, the extra cylinders, having their own cylinder block similar to cylinder block 12 whereby the engine will adopt a V formation, the pistons of the additional cylinders each being connected to the crank shaft 20.

These further cylinders may together with the crankcase and sump 36 have transfer paths to enable precompressed charge to be delivered to the working part of each cylinder. The transfer paths are preferably similarly provided to the transfer paths described for the cylinders 13,14.

A separate auxiliary crank case or sump may be provided to close the lower end of the crank case casting beneath interface $1_2$ which would require casting with grooves, like grooves 37, 38, to provide second passage parts of the crank case.

If desired, more than one pair of cylinders side by side may be provided in a larger crank case where a more powerful engine is required, and/or more than two pairs of cylinders may be arranged in a V formation as described.

The V angle in the example shown is approximately 90° although could of course be of other angles if desired.

Various modifications may be made to the engine described without departing from the scope of the invention.

Although as described, the interface $1_1$, $1_2$ have been at the steps in the cylinders 13,14, between the smaller diameter parts 16a,16b, and the larger diameter parts 15a,15b, if desired the interfaces $1_1$ and $1_2$ may be provided at other positions, although in this event, further ports may be required at the interfaces in the crank case 11 to permit charge to be initially introduced into the larger diameter working part 15a,15b from the ports 52,53, which further ports would need to extend from the interface 11 to the pumping parts of the cylinders 13,14. Furthermore, further ports and passages may be required to permit precompressed fuel to pass from the pumping part 15a,15b in the crankcase to the first passage part of the transfer paths.

As described, the crank case 11 has comprised a main crank case casting and one or more auxiliary crank cases or sumps 36. If desired, a simple cover plate or cover plates could be provided to close the open end of the crankcase in which case the grooves which provide the second passage parts would need to be provided in the main crank casting alone. If desired, the crank case 11 may be provided as a unitary structure although specialised casting would be required. The passages 25,25',29,29' need not be perpendicular to the open end 39 of the crankcase casting 11 where the crank case casting 11 is not to be produced by die casting.

Instead of the group of ports 26,33' and 32' and the group of ports 26',32,33, and corresponding ports 31',27,30' and 30,27',31 being arranged concentrically around the cylinders, if desired, the three ports of each group may lie along a line which may be parallel to the plane P, which also contains the crankshaft axis, or inclined relative thereto.

Preferably again, the three ports of each group are centred on a radius inclined to plane P, at an angle of other than 90° so that the lines of the various groups of ports are skewed relative to one another.

Further alternatively the ports of each group may lie along an arc not concentric with the cylinder.

In another embodiment (not shown) instead of providing a single cylinder block 12 which defines parts of each cylinder 13,14, separate cylinder blocks, one for each cylinder 13,14, may be provided. Each cylinder block would be secured at interface $1_1$, to the crank case 11.

Such an arrangement is possible because the first and third passage parts 25,29;25',29' each cross the interface $1_1$, and the second passage parts 28,28' which interconnect them are solely contained within the crank case 11.

Thus the individual blocks may be independently produced, and/or removed from the crank case 11 for repairs.

The features disclosed in the foregoing description, in the following claims, or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realising the invention in diverse forms thereof.

I claim:

1. An internal combustion engine comprising at least first and second cylinders each containing a stepped piston, each cylinder and piston having a pumping part of larger diameter and a working part of smaller diameter, the working part of each cylinder being charged by precompressed charge delivered from the pumping part of the other cylinder, a crank case and at least one cylinder block secured to the crank case at an interface, the crankcase and the at least one cylinder block together defining the first and second cylinders in which the stepped pistons are slidable, the pistons each being connected to a crank shaft mounted in the crankcase, a first transfer path along which the precompressed charge flows from the pumping part of the first cylinder to the working part of the second cylinder in which the charge is ignited, and a second transfer path along which the precompressed charge flows from the pumping part of the second cylinder to the working part of the first cylinder in which the charge is ignited, the first transfer path comprising first, second and third passage parts, the first passage part communicating with the pumping part of the first cylinder and the second passage part, and the third passage part comprising at least two branches each branch communicating with the second passage part and the working part of the second cylinder, the second transfer path comprising first, second and third passage parts, the first passage part communicating with the pumping part of the second cylinder and the second passage part, and the third passage part comprising at least two branches each branch communicating with the second passage part and the working part of the first cylinder, the first passage part and each of the branches of the third passage parts of each of the first and second transfer paths crossing the interface between the crankcase and the at least one cylinder block via aligned ports in the crankcase and the at least one cylinder block and each of the second passage parts being wholly contained within the crankcase.

2. An engine according to claim 1 wherein the crankcase comprises a main crankcase casting and closure means to close an open end of the main crankcase casting, the first and third passage parts extending from the respective ports at the interface, through the main crankcase casting, to the open end of the crankcase casting, and the second passage part is defined at least partly by the closure means.

3. An engine according to claim 2 wherein the crankcase comprises a main crankcase casting and closure means to close an open end of the main crankcase casting, the open end of the crankcase which is closed in use, by the closure means, defining a first plane inclined relative to a second plane which is defined by the interface of the crankcase and cylinder block.

4. An engine according to claim 3 characterized in that the branches of the third passage parts each extend generally perpendicular to the first plane.

5. An engine according to claim 1 where the branches of the third passage parts which extend from the ports of the cylinder block enter the working part of their associated cylinders in directions which are generally tangential to the associated cylinder.

6. An engine according to claim 1 wherein the ports of the branches of the third passage port of one transfer path are arranged either side of the port of the first passage part of the other transfer path at the interface, the port of the first passage part of the transfer path from the pumping part of one cylinder being arranged adjacent the periphery of said one cylinder.

7. An engine according to claim 6 wherein the port of the first passage part, and adjacent ports of the third passage part of the other transfer path, are arranged along an arc generally concentric with the respective cylinder, the ports of each group of three ports being centered on a radius of the respective cylinder inclined relative to the plane containing the central axes, at an angle other than 90°.

8. An engine according to claim 1 wherein the second passage parts of each of the transfer paths are generally straight along a major portion of their length.

9. An engine according to claim 1 wherein the interface between the at least one cylinder block and the crankcase is provided at the step between the greater diameter pumping parts and the smaller diameter working parts of the cylinders, the port of the first passage part provided in the at least one cylinder block of each transfer path, overlapping the periphery of the larger diameter cylinder part of the crankcase and the port of the first passage part of the crankcase.

10. An engine according to claim 1 wherein the engine is provided with two pairs of cylinders each pair of cylinders being arranged in a V formation, with the at least one cylinder block of each pair adjoining the crankcase at spaced interfaces inclined relative to one another.

* * * * *